US010914499B2

(12) United States Patent
Nakamura et al.

(10) Patent No.: US 10,914,499 B2
(45) Date of Patent: Feb. 9, 2021

(54) OUTDOOR UNIT AND REFRIGERATION CYCLE APPARATUS INCLUDING THE SAME

(71) Applicant: Mitsubishi Electric Corporation, Tokyo (JP)

(72) Inventors: Shin Nakamura, Tokyo (JP); Tsuyoshi Maeda, Tokyo (JP); Akira Ishibashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/083,553

(22) PCT Filed: May 19, 2016

(86) PCT No.: PCT/JP2016/064866
§ 371 (c)(1),
(2) Date: Sep. 10, 2018

(87) PCT Pub. No.: WO2017/199393
PCT Pub. Date: Nov. 23, 2017

(65) Prior Publication Data

US 2019/0078817 A1 Mar. 14, 2019

(51) Int. Cl.
*F25B 39/02* (2006.01)
*F25B 39/04* (2006.01)
(Continued)

(52) U.S. Cl.
CPC ..... *F25B 39/022* (2013.01); *F25B 39/00* (2013.01); *F25B 39/02* (2013.01); *F25B 39/028* (2013.01);
(Continued)

(58) Field of Classification Search
CPC ..... F25B 39/022; F25B 39/00; F25B 39/02; F25B 39/028; F25B 39/04;
(Continued)

(56) References Cited

U.S. PATENT DOCUMENTS 5,875,650 A * 3/1999 Nobuta ..... B60H 1/3227 62/509
9,562,727 B2 * 2/2017 Fujii ..... F28D 1/05375
(Continued)

FOREIGN PATENT DOCUMENTS

EP 3 128 263 A1 2/2017
JP H08-219493 A 8/1996
(Continued)

OTHER PUBLICATIONS

International Search Report of the International Searching Authority dated Aug. 9, 2016 for the corresponding International application No. PCT/JP2016/064866 (and English translation).
(Continued)

*Primary Examiner* — Henry T Crenshaw
(74) *Attorney, Agent, or Firm* — Posz Law Group, PLC

(57) ABSTRACT

An outdoor heat exchanger of an outdoor unit includes a main heat exchanger portion and an auxiliary heat exchanger portion. In the main heat exchanger portion, refrigerant path groups are formed. In the auxiliary heat exchanger portion, refrigerant paths are formed. The refrigerant path in the auxiliary heat exchanger portion, which is located closest to the main heat exchanger portion, is connected to the refrigerant path group in the main heat exchanger portion, which is disposed in a region where a wind velocity of the outdoor air passing through the main heat exchanger portion is relatively high. In addition, the refrigerant path is connected to the refrigerant path group. The refrigerant path is con-
(Continued)

nected to the refrigerant path group. The refrigerant path is connected to the refrigerant path group.

11 Claims, 12 Drawing Sheets

(51) Int. Cl.
*F25B 39/00* (2006.01)
*F28D 1/04* (2006.01)
*F28D 1/053* (2006.01)
*F28D 21/00* (2006.01)

(52) U.S. Cl.
CPC ..... *F25B 39/04* (2013.01); *F28D 1/0417* (2013.01); *F28D 1/0443* (2013.01); *F28D 1/0452* (2013.01); *F28D 1/053* (2013.01); *F28D 1/05308* (2013.01); *F28D 1/05391* (2013.01); *F25B 2339/022* (2013.01); *F25B 2339/043* (2013.01); *F28D 2021/0068* (2013.01)

(58) Field of Classification Search
CPC ..... F25B 2339/022; F25B 2339/0068; F28D 1/0417; F28D 1/0443; F28D 1/0452; F28D 1/053; F28D 1/05308; F28D 1/05391; F28D 2021/0068
See application file for complete search history.

(56) References Cited

U.S. PATENT DOCUMENTS

| | | | | |
|---|---|---|---|---|
| 2013/0306285 | A1* | 11/2013 | Jindou ..... | F25B 39/00 165/173 |
| 2015/0059401 | A1 | 3/2015 | Matsuda et al. | |
| 2015/0101363 | A1* | 4/2015 | Matsuda ..... | F25B 39/028 62/525 |
| 2016/0187049 | A1 | 6/2016 | Hokazono et al. | |
| 2016/0223265 | A1 | 8/2016 | Jindou et al. | |

FOREIGN PATENT DOCUMENTS

| | | | |
|---|---|---|---|
| JP | 2010-127570 | A | 6/2010 |
| JP | 2012-163328 | A | 8/2012 |
| JP | 2013-083419 | A | 5/2013 |
| JP | 2015-052439 | A | 3/2015 |
| JP | 2015-055406 | A | 3/2015 |
| JP | 2015-078830 | A | 4/2015 |
| KR | 10-0505236 | B1 | 8/2005 |
| WO | 2013/161799 | A1 | 10/2013 |
| WO | 2014/199501 | A1 | 12/2014 |
| WO | 2015/111220 | A1 | 7/2015 |
| WO | 2015/132963 | A1 | 9/2015 |

OTHER PUBLICATIONS

Office Action dated Jul. 30, 2019 issued in corresponding JP patent application No. 2018-518018 (and English translation).
Extended European Search Report dated Apr. 11, 2019 issued in corresponding EP patent application No. 16902412.2.
Office Action dated Feb. 25, 2020 issued in corresponding JP patent application No. 2018-518018 (and English translation).
Office Action dated Jun. 22, 2020 issued in corresponding EP patent application No. 16902412.2.
Extended European Search Report dated Dec. 17, 2020 issued in corresponding EP application No. 20201281.1.

* cited by examiner

OUTDOOR UNIT AND REFRIGERATION CYCLE APPARATUS INCLUDING THE SAME

CROSS REFERENCE TO RELATED APPLICATION

This application is a U.S. national stage application of PCT/JP2016/064866 filed on May 19, 2016, the contents of which are incorporated herein by reference.

TECHNICAL FIELD

The present invention relates to an outdoor unit and a refrigeration cycle apparatus including the same. Particularly, the present invention relates to an outdoor unit including an outdoor heat exchanger having a main heat exchanger portion and an auxiliary heat exchanger portion, and a refrigeration cycle apparatus including the outdoor unit.

BACKGROUND ART

An air conditioning apparatus as a refrigeration cycle apparatus includes a refrigerant circuit having an indoor unit and an outdoor unit. Such an air conditioning apparatus can perform a cooling operation and a heating operation by switching a flow path of the refrigerant circuit using a four-way valve or the like.

The indoor unit is provided with an indoor heat exchanger. In the indoor heat exchanger, heat exchange is performed between refrigerant flowing through the refrigerant circuit and the indoor air supplied by an indoor fan. The outdoor unit is provided with an outdoor heat exchanger. In the outdoor heat exchanger, heat exchange is performed between the refrigerant flowing through the refrigerant circuit and the outdoor air supplied by an outdoor fan.

One type of the outdoor heat exchanger used in the air conditioning apparatus is an outdoor heat exchanger in which a heat transfer tube is disposed so as to penetrate through a plurality of plate-shaped fins. Such an outdoor heat exchanger is called "fin and tube-type heat exchanger". In this fin and tube-type heat exchanger, a small-diameter heat transfer tube is in some cases used for efficient heat exchange. Furthermore, a flat tube having a flat cross-sectional shape is in some cases used as such a heat transfer tube.

One example of the outdoor heat exchanger of this type is an outdoor heat exchanger including a main heat exchanger portion for condensation and an auxiliary heat exchanger portion for supercooling. Generally, the main heat exchanger portion is disposed above the auxiliary heat exchanger portion. When the air conditioning apparatus performs the cooling operation, the outdoor heat exchanger functions as a condenser. While the refrigerant supplied into the outdoor heat exchanger flows through the main heat exchanger portion, heat exchange is performed between the refrigerant and the air, and thus, the refrigerant condenses to liquid refrigerant. After flowing through the main heat exchanger portion, the liquid refrigerant flows through the auxiliary heat exchanger portion and is further cooled.

On the other hand, when the air conditioning apparatus performs the heating operation, the outdoor heat exchanger functions as an evaporator. While the refrigerant supplied into the outdoor heat exchanger flows through the main heat exchanger portion from the auxiliary heat exchanger portion, heat exchange is performed between the refrigerant and the air, and thus, the refrigerant evaporates to gas refrigerant. One example of the patent documents disclosing this type of air conditioning apparatus including an outdoor heat exchanger is PTD 1.

CITATION LIST

Patent Document

PTD 1: Japanese Patent Laying-Open No. 2013-83419

SUMMARY OF INVENTION

Technical Problem

When an air conditioning apparatus performs the heating operation or the cooling operation, the outdoor air supplied by an outdoor fan passes through an outdoor heat exchanger. At this time, a region where the wind velocity of the outdoor air passing through the outdoor heat exchanger is high and a region where the wind velocity of the outdoor air is low are generated, depending on the arrangement relation between the outdoor heat exchanger and the outdoor fan, and the like. Therefore, in the outdoor heat exchanger, variations in heat exchange between the refrigerant and the outdoor air may occur, and thus, efficient heat exchange is not performed in some cases.

When a small-diameter heat transfer tube is used as a heat transfer tube, the number of refrigerant paths connected in parallel increases, and thus, it becomes difficult to make a phase state of liquid refrigerant and gas refrigerant in the heat transfer tube uniform based on the order of connection of the refrigerant paths.

Furthermore, there is also a method for adjusting a balance of an amount of refrigerant flowing into each refrigerant path, by connecting a small-diameter tube called "capillary tube" to each refrigerant path and adjusting a pressure loss caused by friction of the refrigerant flowing into each refrigerant path.

However, according to this method, when a defrosting operation is performed with frost adhering to the outdoor heat exchanger, for example, variations in flow velocity of the refrigerant occur, and thus, variations in melting of the frost occur. As a result, the defrosting time becomes longer and the consumed power increases. In addition, the heating capacity per certain time period decreases. Furthermore, when the heating operation is repeated before the frost melts completely, the remaining frost may grow and damage the outdoor heat exchanger.

As described above, in the outdoor unit, the heat exchange performance may deteriorate due to wind velocity distribution of the outdoor air passing through the outdoor heat exchanger. Therefore, an outdoor unit having higher heat exchange performance is desired.

The present invention has been made as a part of development, and one object is to provide an outdoor unit having improved heat exchange performance, and another object is to provide a refrigeration cycle apparatus including the outdoor unit.

Solution to Problem

One outdoor unit according to the present invention is an outdoor unit including an outdoor heat exchanger. The outdoor heat exchanger includes: a first heat exchanger portion; and a second heat exchanger portion disposed so as to be in contact with the first heat exchanger portion. The first heat exchanger portion has a plurality of first refrigerant paths. The second heat exchanger portion has a plurality of second refrigerant paths. A first path of the plurality of first refrigerant paths is connected to a second path of the plurality of second refrigerant paths, the first path being located closest to the second heat exchanger portion, the second path being disposed in a region where a flow velocity of a fluid passing through the second heat exchanger portion is relatively high.

Another outdoor unit according to the present invention is an outdoor unit including an outdoor heat exchanger. The outdoor heat exchanger includes: a first heat exchanger portion; and a second heat exchanger portion disposed so as to be in contact with the first heat exchanger portion. The first heat exchanger portion has a plurality of first refrigerant paths. The second heat exchanger portion has a plurality of second refrigerant paths. A first path of the plurality of first refrigerant paths is connected to a second path of the plurality of second refrigerant paths, the first path being located farthest from the second heat exchanger portion, the second path being disposed in a region where a flow velocity of a fluid passing through the second heat exchanger portion is relatively high.

A refrigeration cycle apparatus according to the present invention is a refrigeration cycle apparatus including one outdoor unit or another outdoor unit described above.

Advantageous Effects of Invention

In one outdoor unit according to the present invention, the first path of the plurality of first refrigerant paths is connected to the second path of the plurality of second refrigerant paths, the first path being located closest to the second heat exchanger portion, the second path being disposed in the region where the flow velocity of the fluid passing through the second heat exchanger portion is relatively high. Thus, when the outdoor heat exchanger operates as an evaporator, the refrigerant including a larger amount of liquid refrigerant flows from the first path to the second path disposed in the region where the flow velocity of the fluid passing through the second heat exchanger portion is relatively high. As a result, the heat exchange performance of the outdoor heat exchanger of the outdoor unit can be improved.

In another outdoor unit according to the present invention, the first path of the plurality of first refrigerant paths is connected to the second path of the plurality of second refrigerant paths, the first path being located farthest from the second heat exchanger portion, the second path being disposed in the region where the flow velocity of the fluid passing through the second heat exchanger portion is relatively high. Thus, when the outdoor heat exchanger operates as an evaporator, the refrigerant including a larger amount of liquid refrigerant flows from the first path to the second path disposed in the region where the flow velocity of the fluid passing through the second heat exchanger portion is relatively high. As a result, the heat exchange performance of the outdoor heat exchanger of the outdoor unit can be improved.

In the refrigeration cycle apparatus according to the present invention, one outdoor unit or another outdoor unit described above is included, and thus, the heat exchange performance of the refrigeration cycle apparatus can be improved.

DESCRIPTION OF EMBODIMENTS

First Embodiment

Figure 1:
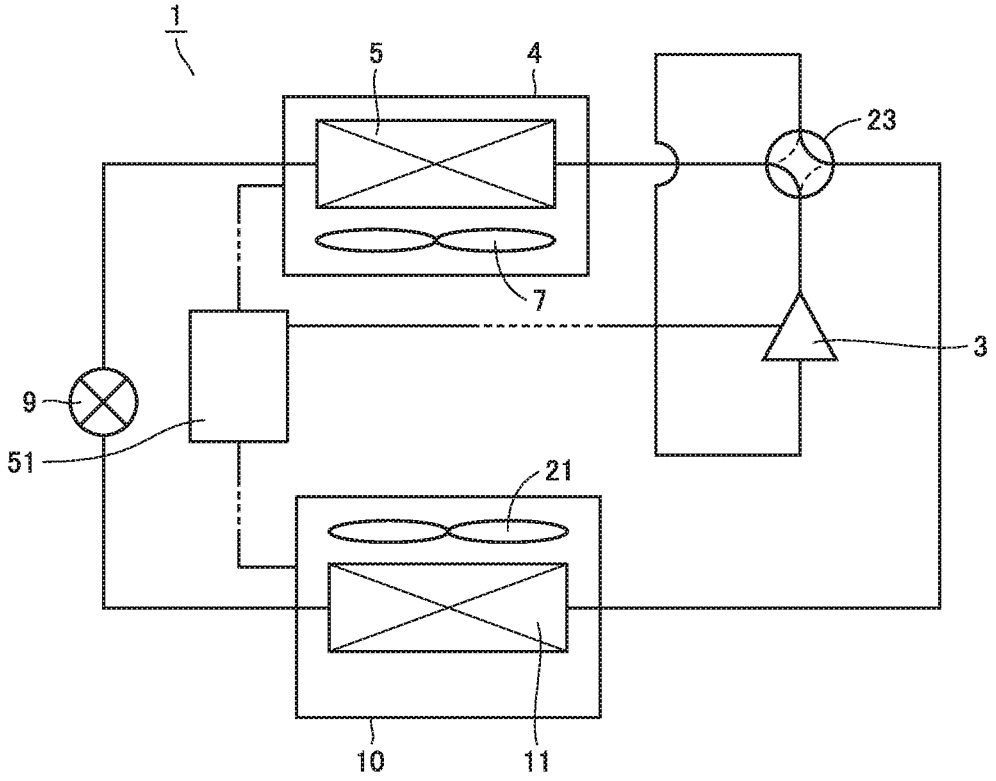
FIG. 1 shows one example of a refrigerant circuit of an air conditioning apparatus according to each embodiment.

First, an overall configuration (refrigerant circuit) of an air conditioning apparatus as a refrigeration cycle apparatus will be described. As shown in FIG. 1, an air conditioning apparatus 1 includes a compressor 3, an indoor heat exchanger 5, an indoor fan 7, a throttle device 9, an outdoor heat exchanger 11, an outdoor fan 21, a four-way valve 23, and a controller 51. Compressor 3, indoor heat exchanger 5, throttle device 9, outdoor heat exchanger 11, and four-way valve 23 are connected by a refrigerant pipe.

Indoor heat exchanger 5 and indoor fan 7 are disposed in an indoor unit 4. Outdoor heat exchanger 11 and outdoor fan 21 are disposed in an outdoor unit 10. A series of operation of air conditioning apparatus 1 is controlled by controller 51.

Figure 2:
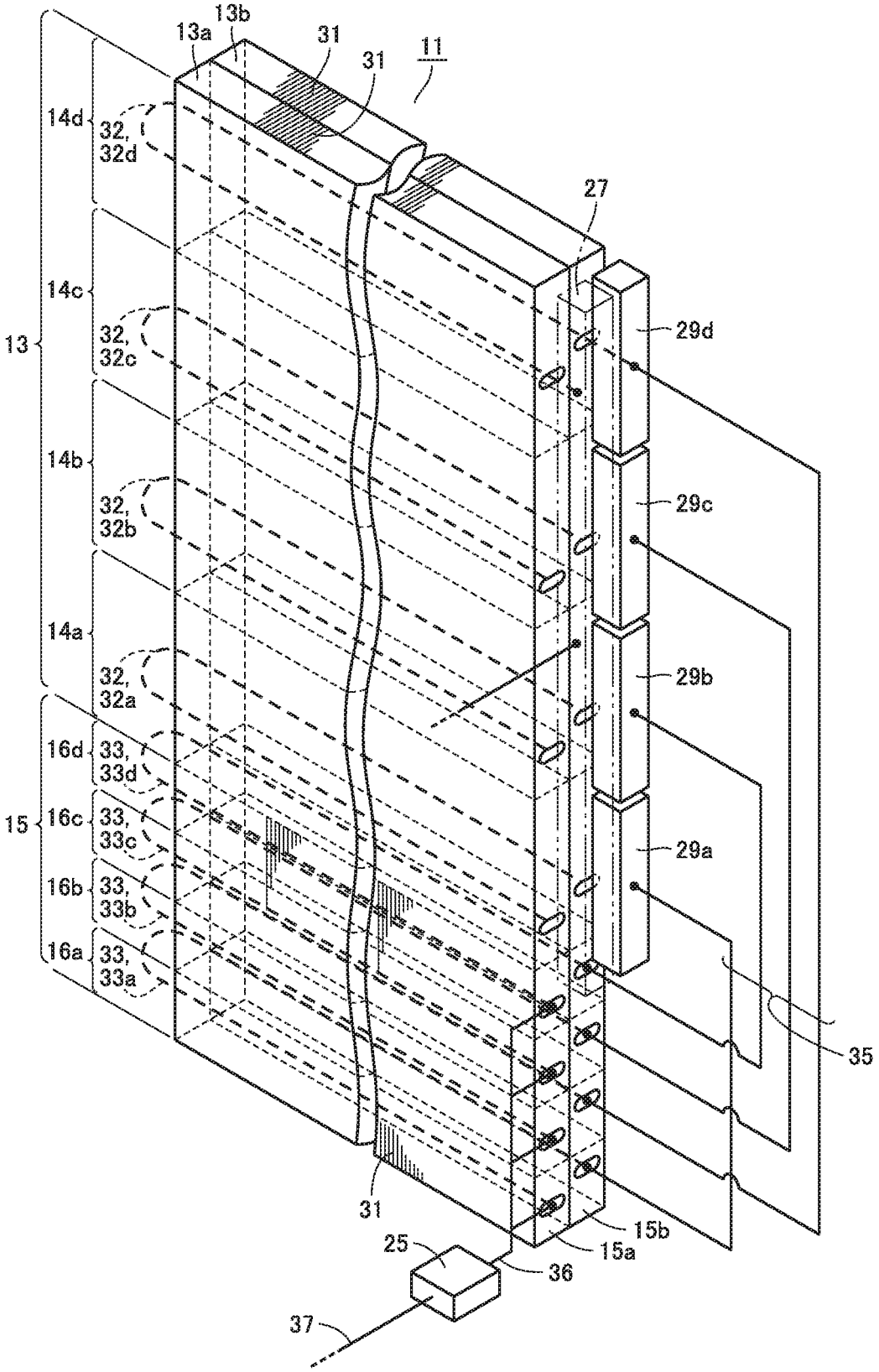
FIG. 2 is a perspective view showing an outdoor heat exchanger according to a first embodiment.

Next, outdoor heat exchanger 11 will be described. As shown in FIG. 2, outdoor heat exchanger 11 includes a main heat exchanger portion 13 (second heat exchanger portion) and an auxiliary heat exchanger portion 15 (first heat exchanger portion). Main heat exchanger portion 13 is disposed above auxiliary heat exchanger portion 15. In main heat exchanger portion 13, a main heat exchanger portion 13*a* is disposed on a first row and a main heat exchanger portion 13*b* is disposed on a second row. In auxiliary heat exchanger portion 15, an auxiliary heat exchanger portion 15*a* is disposed on a first row and an auxiliary heat exchanger portion 15*b* is disposed on a second row.

In main heat exchanger portion 13 (13*a*, 13*b*), a plurality of heat transfer tubes 32 (32*a*, 32*b*, 32*c*, and 32*d*) (second refrigerant paths) are disposed so as to penetrate through a plurality of plate-shaped fins 31. In auxiliary heat exchanger portion 15 (15*a*, 15*b*), a plurality of heat transfer tubes 33 (33*a*, 33*b*, 33*c*, and 33*d*) (first refrigerant paths) are disposed so as to penetrate through the plurality of plate-shaped fins 31.

Figure 3:
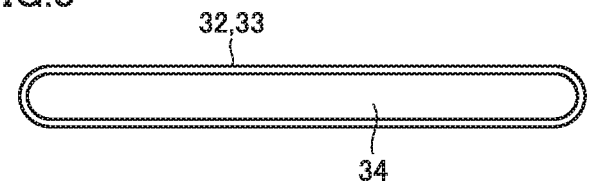
FIG. 3 is a cross-sectional view showing one example of a refrigerant passage of a heat transfer tube in the first embodiment.
Figure 4:
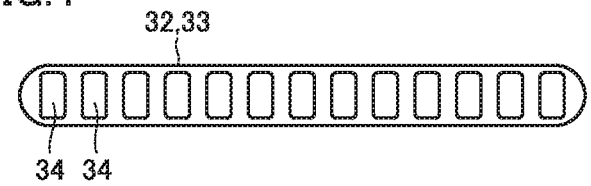
FIG. 4 is a cross-sectional view showing another example of the refrigerant passage of the heat transfer tube in the first embodiment.

A flat tube having a flat cross-sectional shape with a major axis and a minor axis is, for example, used as each of heat transfer tubes 32 and 33. As one example of the flat tube, FIG. 3 shows a flat tube having one refrigerant passage 34 formed therein. As another example of the flat tube, FIG. 4 shows a flat tube having a plurality of refrigerant passages 34 formed therein. Each of heat transfer tubes 32 and 33 is not limited to the flat tube and a heat transfer tube having a circular cross-sectional shape, an elliptical cross-sectional shape or the like may, for example, be used.

In outdoor heat exchanger 11, refrigerant paths are formed by heat transfer tubes 32 and 33. In main heat exchanger portion 13, a refrigerant path group 14*a*, a refrigerant path group 14*b*, a refrigerant path group 14*c*, and a refrigerant path group 14*d* are formed. In refrigerant path group 14*a*, a plurality of refrigerant paths including one refrigerant path formed by heat transfer tube 32*a* are formed. In refrigerant path group 14*b*, a plurality of refrigerant paths including one refrigerant path formed by heat transfer tube 32*b* are formed. In refrigerant path group 14*c*, a plurality of refrigerant paths including one refrigerant path formed by heat transfer tube 32*c* are formed. In refrigerant path group 14*d*, a plurality of refrigerant paths including one refrigerant path formed by heat transfer tube 32*d* are formed.

In auxiliary heat exchanger portion 15, a refrigerant path 16*a*, a refrigerant path 16*b*, a refrigerant path 16*c*, and a refrigerant path 16*d* are formed by heat transfer tubes 33. Refrigerant path 16*a* is formed by heat transfer tube 33*a*. Refrigerant path 16*b* is formed by heat transfer tube 33*b*. Refrigerant path 16*c* is formed by heat transfer tube 33*c*. Refrigerant path 16*d* is formed by heat transfer tube 33*d*.

One end side of refrigerant path groups 14*a* to 14*d* in main heat exchanger portion 13 and one end side of refrigerant paths 16*a* to 16*d* in auxiliary heat exchanger portion 15 are connected by a connection pipe 35 with distribution devices 29*a* to 29*d* being interposed. More specifically, refrigerant path 16*a* is connected to refrigerant path group 14*a*. Refrigerant path 16*b* is connected to refrigerant path group 14*d*. Refrigerant path 16*c* is connected to refrigerant path group 14*c*. Refrigerant path 16*d* (first path) is connected to refrigerant path group 14*b* (second path)

The other end side of refrigerant path groups 14*a* to 14*d* in the main heat exchanger portion is connected to a header 27. The other end side of refrigerant paths 16*a* to 16*d* in auxiliary heat exchanger portion 15 is connected to a distribution device 25 by a connection pipe 36. Outdoor heat exchanger 11 is configured as described above.

Next, the operation during cooling operation will be described first as the operation of the air conditioning apparatus including outdoor unit 10 (see FIG. 1) having above-described outdoor heat exchanger 11.

Figure 5:
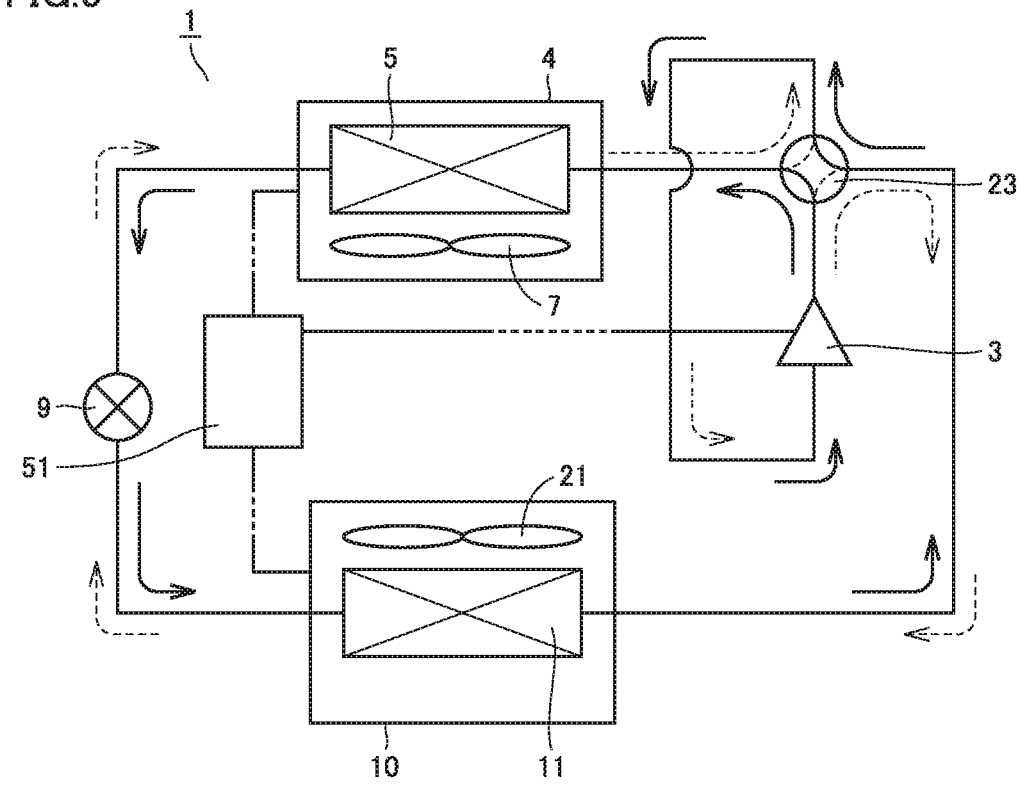
FIG. 5 shows a flow of refrigerant in the refrigerant circuit for describing the operation of the air conditioning apparatus in the first embodiment.

As shown in FIG. 5, compressor 3 is driven and the high-temperature and high-pressure gaseous refrigerant is thereby discharged from compressor 3. Then, the refrigerant flows as shown by a dotted arrow. The discharged high-temperature and high-pressure gas refrigerant (single phase) flows through four-way valve 23 into outdoor heat exchanger 11 of outdoor unit 10. In outdoor heat exchanger 11, heat exchange is performed between the refrigerant flowing into outdoor heat exchanger 11 and the outdoor air (air) as a fluid supplied by outdoor fan 21. The high-temperature and high-pressure gas refrigerant condenses to high-pressure liquid refrigerant (single phase).

The high-pressure liquid refrigerant delivered from outdoor heat exchanger 11 turns into refrigerant in a two-phase state of low-pressure gas refrigerant and liquid refrigerant by throttle device 9. The refrigerant in the two-phase state flows into indoor heat exchanger 5 of indoor unit 4. In indoor heat exchanger 5, heat exchange is performed between the refrigerant in the two-phase state flowing into indoor heat exchanger 5 and the air supplied by indoor fan 7. The liquid refrigerant of the refrigerant in the two-phase state evaporates to low-pressure gas refrigerant (single phase). As a result of this heat exchange, the interior of a room is cooled. The low-pressure gas refrigerant delivered from indoor heat exchanger 5 flows through four-way valve 23 into compressor 3, is compressed to high-temperature and high-pressure gas refrigerant, and is discharged from compressor 3 again. Thereafter, this cycle is repeated.

Figure 6:
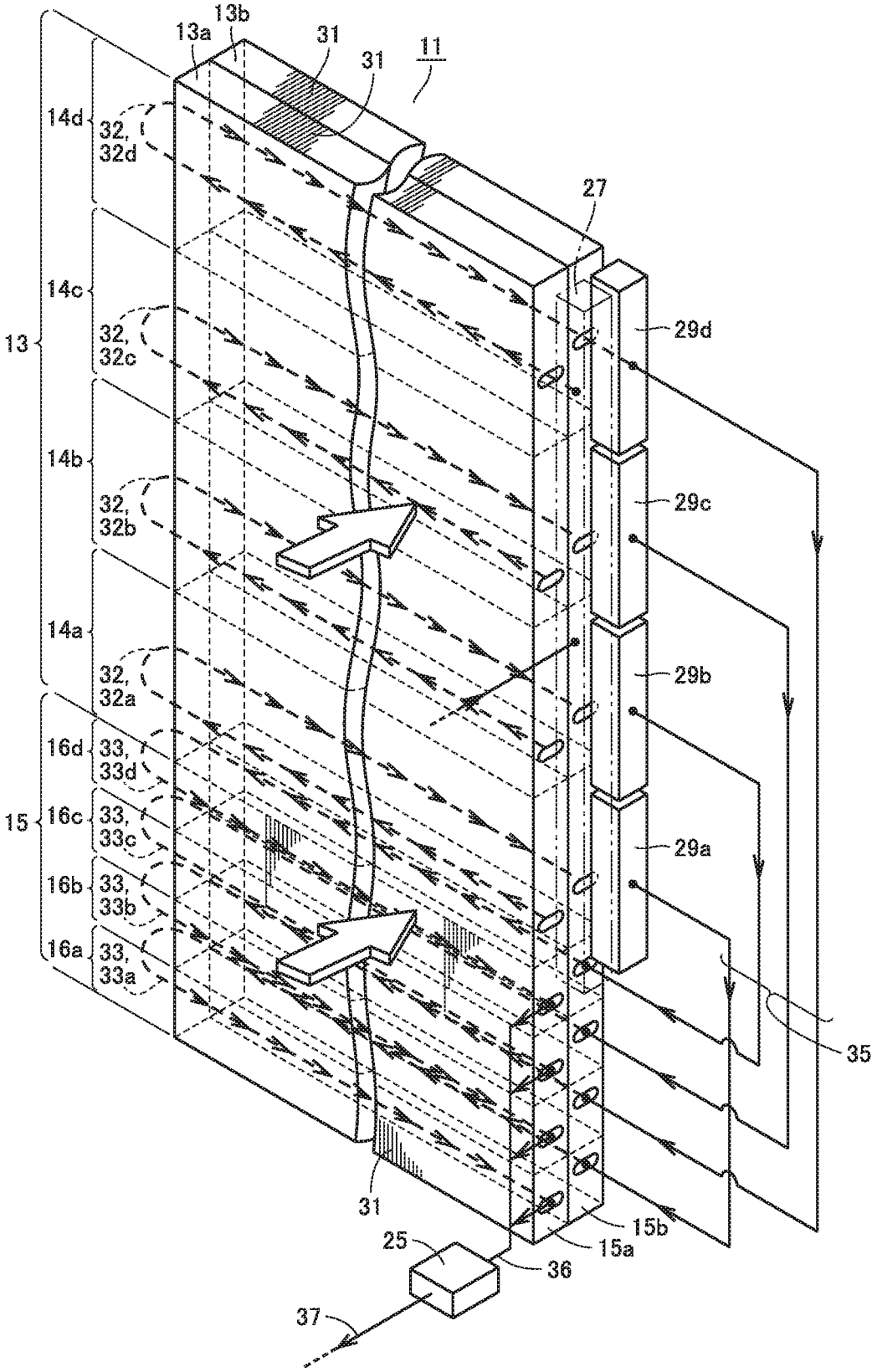
FIG. 6 shows a flow of refrigerant in the outdoor heat exchanger when the outdoor heat exchanger operates as a condenser in the first embodiment.

Next, a flow of the refrigerant in outdoor heat exchanger 11 during cooling operation will be described in detail. As shown in FIG. 6, in outdoor heat exchanger 11, the refrigerant supplied from the compressor flows through main heat exchanger portion 13, and then, flows through auxiliary heat exchanger portion 15. The air supplied into main heat exchanger portion 13 and auxiliary heat exchanger portion 15 by outdoor fan 21 flows from main heat exchanger portion 13*a* and auxiliary heat exchanger portion 15*a* on the first row (windward side) toward main heat exchanger portion 13*b* and auxiliary heat exchanger portion 15*b* on the second row (leeward row) (see a thick arrow).

The high-temperature and high-pressure gas refrigerant supplied from compressor 3 first flows into header 27. The refrigerant flowing into header 27 flows through refrigerant path groups 14*a* to 14*d* in main heat exchanger portion 13 in a direction shown by an arrow. The refrigerant flowing through refrigerant path group 14*a* flows into distribution device 29*a*. The refrigerant flowing through refrigerant path group 14*b* flows into distribution device 29*b*. The refrigerant flowing through refrigerant path group 14*c* flows into distribution device 29*c*. The refrigerant flowing through refrigerant path group 14*d* flows into distribution device 29*d*. The refrigerant flowing into each of distribution devices 29*a* to 29*d* is joined in each of distribution devices 29*a* to 29*d*.

Next, the joined refrigerant flows from each of distribution devices 29*a* to 29*d* through connection pipe 35 into auxiliary heat exchanger portion 15. The refrigerant flowing into auxiliary heat exchanger portion 15 flows through refrigerant paths 16*a* to 16*d* in a direction shown by an arrow. The refrigerant supplied from distribution device 29*a* flows through refrigerant path 16*a*. The refrigerant supplied from distribution device 29*b* flows through refrigerant path 16*d* The refrigerant supplied from distribution device 29*c* flows through refrigerant path 16*c*. The refrigerant supplied from distribution device 29*d* flows through refrigerant path 16*b*.

The refrigerant flowing through refrigerant paths 16*a* to 16*d* flows into distribution device 25 via connection pipe 36. The refrigerant flowing into distribution device 25 is joined in distribution device 25, flows through a connection pipe 37, and is delivered to the outside of outdoor heat exchanger 11.

When outdoor heat exchanger 11 operates as a condenser, the refrigerant generally flows into outdoor heat exchanger 11 as gas refrigerant (single phase) having the degree of superheating. In outdoor heat exchanger 11, heat exchange is performed between the outdoor air (air) and the refrigerant in the two-phase state of liquid refrigerant and gas refrigerant, which is known to be excellent in heat transfer property. The refrigerant subjected to heat exchange is delivered from outdoor heat exchanger 11 as liquid refrigerant (single phase) having the degree of supercooling.

The liquid refrigerant (single phase) is lower than the refrigerant in the two-phase state in terms of a heat transfer rate and a pressure loss in the heat transfer tubes. In addition, the degree of supercooling of the refrigerant is high in the heat transfer tubes, and thus, a difference between a temperature of the refrigerant and a temperature outside the heat transfer tubes is small. Therefore, the performance of the outdoor heat exchanger deteriorates significantly.

Therefore, auxiliary heat exchanger portion 15 of outdoor heat exchanger 11 is disposed such that the number of refrigerant paths 16*a* to 16*d* in auxiliary heat exchanger portion 15 is smaller than the number of refrigerant path groups 14*a* to 14*d* in main heat exchanger portion 13. As a result, a flow velocity of the refrigerant in heat transfer tube 33 in auxiliary heat exchanger portion 15 can be increased and a heat transfer rate in heat transfer tube 33 can be increased.

In addition, as the refrigerant, the liquid refrigerant (single phase) flows through heat transfer tube 33 in auxiliary heat exchanger portion 15. Therefore, a pressure loss in heat transfer tube 33 is also low, and thus, the performance of the outdoor heat exchanger can be improved without adversely affecting the performance of outdoor heat exchanger 11. Particularly when a flow path cross-sectional area in the heat transfer tube is small, the flow velocity of the refrigerant per one refrigerant path is reduced in order to prevent the pressure loss in the heat transfer tube from increasing. As a result, the effect of promoting heat transfer of the liquid refrigerant in the heat transfer tube can be significantly achieved.

Next, the operation during heating operation will be described. As shown in FIG. 5, compressor 3 is driven and the high-temperature and high-pressure gaseous refrigerant is thereby discharged from compressor 3. Then, the refrigerant flows as shown by a solid arrow. The discharged high-temperature and high-pressure gas refrigerant (single phase) flows through four-way valve 23 into indoor heat exchanger 5. In indoor heat exchanger 5, heat exchange is performed between the gas refrigerant flowing into indoor heat exchanger 5 and the air supplied by indoor fan 7. The high-temperature and high-pressure gas refrigerant condenses to high-pressure liquid refrigerant (single phase). As a result of this heat exchange, the interior of a room is heated. The high-pressure liquid refrigerant delivered from indoor heat exchanger 5 turns into refrigerant in a two-phase state of low-pressure gas refrigerant and liquid refrigerant by throttle device 9.

The refrigerant in the two-phase state flows into outdoor heat exchanger 11. In outdoor heat exchanger 11, heat exchange is performed between the refrigerant in the two-phase state flowing into outdoor heat exchanger 11 and the outdoor air (air) as a fluid supplied by outdoor fan 21. The liquid refrigerant of the refrigerant in the two-phase state evaporates to low-pressure gas refrigerant (single phase). The low-pressure gas refrigerant delivered from outdoor heat exchanger 11 flows through four-way valve 23 into compressor 3, is compressed to high-temperature and high-pressure gas refrigerant, and is discharged from compressor 3 again. Thereafter, this cycle is repeated.

Figure 7:
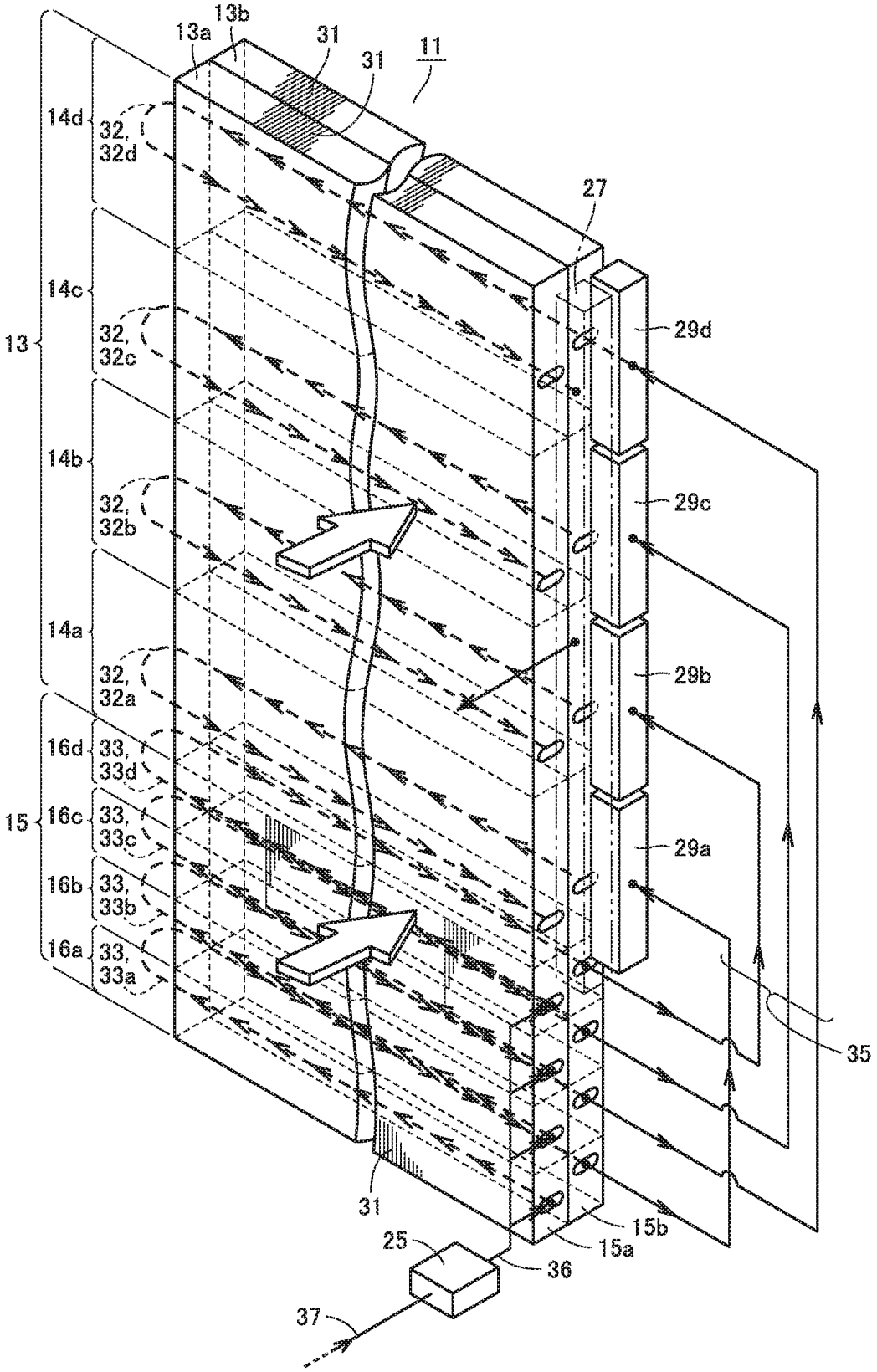
FIG. 7 shows a flow of refrigerant in the outdoor heat exchanger when the outdoor heat exchanger operates as an evaporator in the first embodiment.

Next, a flow of the refrigerant in outdoor heat exchanger 11 during heating operation will be described in detail. As shown in FIG. 7, in outdoor heat exchanger 11, the supplied refrigerant flows through auxiliary heat exchanger portion 15, and then, flows through main heat exchanger portion 13. The air supplied into main heat exchanger portion 13 and auxiliary heat exchanger portion 15 by outdoor fan 21 flows from main heat exchanger portion 13*a* and auxiliary heat exchanger portion 15*a* on the first row (windward side) toward main heat exchanger portion 13*b* and auxiliary heat exchanger portion 15*b* on the second row (leeward row) (see a thick arrow).

The refrigerant in the two-phase state supplied from indoor heat exchanger 5 through throttle device 9 first flows into distribution device 25. The refrigerant flowing into distribution device 25 flows through refrigerant paths 16*a* to 16*d* in auxiliary heat exchanger portion 15 in a direction shown by an arrow. The refrigerant flowing through refrigerant path 16*a* flows into distribution device 29*a* via connection pipe 35. The refrigerant flowing through refrigerant path 16*b* flows into distribution device 29*d* via connection pipe 35. The refrigerant flowing through refrigerant path 16*c* flows into distribution device 29*c* via connection pipe 35. The refrigerant flowing through refrigerant path 16*d* flows into distribution device 29*b* via connection pipe 35.

Next, the refrigerant flowing into each of distribution devices 29*a* to 29*d* flows through refrigerant path groups 14*a* to 14*d* in main heat exchanger portion 13 in a direction shown by an arrow. The refrigerant flowing into distribution device 29*a* flows through refrigerant path group 14*a*. The refrigerant flowing into distribution device 29*b* flows through refrigerant path group 14*b*. The refrigerant flowing into distribution device 29*c* flows through refrigerant path group 14*c*. The refrigerant flowing into distribution device 29*d* flows through refrigerant path group 14*d*. The refrigerant flowing through each of refrigerant path groups 14*a* to 14*d* flows into header 27. The refrigerant flowing into header 27 is delivered to the outside of outdoor heat exchanger 11.

The refrigerant flowing through outdoor heat exchanger 11 is supplied to compressor 3. If the refrigerant flows into compressor 3 in the liquid refrigerant state at this time, liquid compression may occur, which may cause a failure of compressor 3. Therefore, during heating operation in which outdoor heat exchanger 11 functions as an evaporator, the refrigerant delivered from outdoor heat exchanger 11 is desirably the gas refrigerant (single phase).

As described above, during heating operation, heat exchange is performed between the outdoor air supplied into outdoor unit 10 by outdoor fan 21 and the refrigerant supplied into outdoor heat exchanger 11. During this heat exchange, the moisture in the outdoor air (air) condenses and water droplets grow on a surface of outdoor heat exchanger 11. The grown water droplets flow downward through a drainage path of outdoor heat exchanger 11 formed by fins 31 and heat transfer tubes 32 and 33, and are discharged as the drain water.

In addition, during heating operation, the condensed moisture in the air may adhere to outdoor heat exchanger 11 as frost. Therefore, air conditioning apparatus 1 performs the defrosting operation for removing the frost when the temperature of the outdoor air becomes equal to or lower than a certain temperature (for example, 0° C. (freezing point)).

The defrosting operation refers to the operation for supplying the high-temperature and high-pressure gas refrigerant (hot gas) from compressor 3 to outdoor heat exchanger 11 in order to prevent the frost from adhering to outdoor heat exchanger 11 functioning as an evaporator. The defrosting operation may be performed when a duration of the heating operation reaches a prescribed value (for example, 30 minutes). Alternatively, the defrosting operation may be performed before the heating operation, when the temperature of the outdoor air is equal to or lower than a certain temperature (for example, −6° C.). The frost (and ice) adhering to outdoor heat exchanger 11 is melted by the high-temperature and high-pressure refrigerant supplied into outdoor heat exchanger 11.

In air conditioning apparatus 1, the high-temperature and high-pressure gas refrigerant discharged from compressor 3 can be supplied into outdoor heat exchanger 11 through four-way valve 23. In addition to four-way valve 23, a bypass refrigerant pipe (not shown) may, for example, be provided between compressor 3 and outdoor heat exchanger 11.

Figure 8:
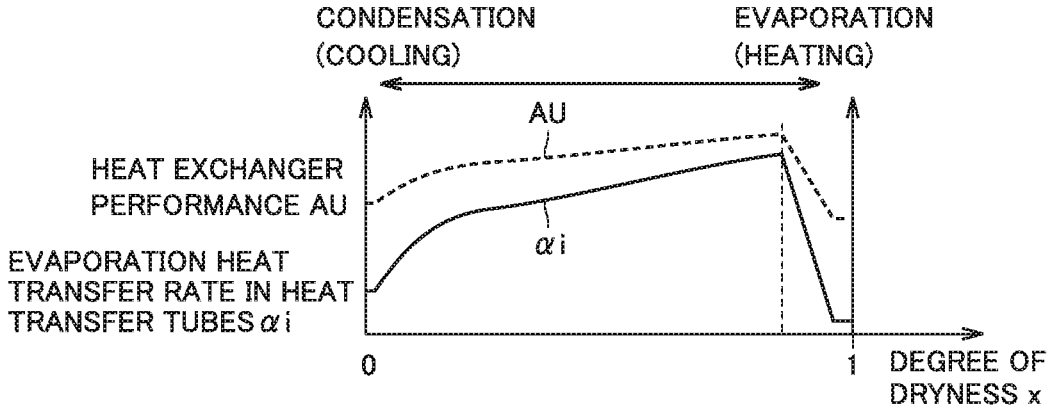
FIG. 8 is a graph showing the relation between an evaporation heat transfer rate in the heat transfer tubes and the degree of dryness as well as the relation between the heat exchanger performance and the degree of dryness in the first embodiment.

As described above, when outdoor heat exchanger 11 functions as an evaporator, the refrigerant in the two-phase state of liquid refrigerant and gas refrigerant flowing into outdoor heat exchanger 11 evaporates to gas refrigerant, while the refrigerant flows through outdoor heat exchanger 11. The relation (relation A) between the degree of dryness x of the refrigerant in the two-phase state and an evaporation heat transfer rate $\alpha i$ in the heat transfer tubes as well as the relation (relation B) between the degree of dryness x of the refrigerant in the two-phase state and a heat exchanger performance AU value as an evaporator will be described. FIG. 8 shows a graph of relation A (graph shown by a solid line) and a graph of relation B (graph shown by a dotted line).

Assuming that Ro represents a thermal resistance outside the heat transfer tubes, Ri represents a thermal resistance in the heat transfer tubes, and Rd represents a thermal resistance in heat transfer tube walls, the AU value is expressed by the following equation:

$$AU \text{ value} = 1/(Ro+Ri+Rd).$$

As the thermal resistance values become smaller, the AU value becomes higher and the heat exchange performance is improved. For example, in order to decrease thermal resistance Ro outside the heat transfer tubes, it is necessary to include a mechanism for increasing a heat transfer area outside the heat transfer tubes, or increasing a flow velocity of the fluid outside the heat transfer tubes, or improving a heat transfer rate outside the heat transfer tubes. In order to decrease thermal resistance Ri in the heat transfer tubes, it is necessary to increase evaporation heat transfer rate $\alpha i$ in the heat transfer tubes, or increase a heat transfer area in the heat transfer tubes.

Generally, in heat transfer tubes 32 and 33 of outdoor heat exchanger 11 into which the refrigerant in the two-phase state flows, the liquid refrigerant and the gas refrigerant coexist. The liquid refrigerant exists as a thin liquid film adhering to inner wall surfaces of heat transfer tubes 32 and 33. Therefore, when the refrigerant in the two-phase state in heat transfer tubes 32 and 33 evaporates, the evaporation heat transfer rate in the heat transfer tubes is high and the heat exchanger performance AU value also shows a high value, as compared with the case of the single-phase refrigerant (liquid refrigerant or gas refrigerant).

In the case of the refrigerant in the two-phase state, as the liquid refrigerant evaporates, a percentage of the gas refrigerant increases and the refrigerant comes close to a state of only the single-phase gas refrigerant. That is, the degree of dryness of the refrigerant becomes higher. When the degree of dryness becomes higher, there occurs a phenomenon called "dryout" in which the liquid refrigerant (liquid film) formed on the inner wall surfaces of heat transfer tubes 32 and 33 dries. Therefore, as shown in FIG. 8, evaporation heat transfer rate $\alpha i$ in heat transfer tubes 32 and 33 decreases rapidly. The heat exchanger performance AU value also becomes lower rapidly.

Figure 9:
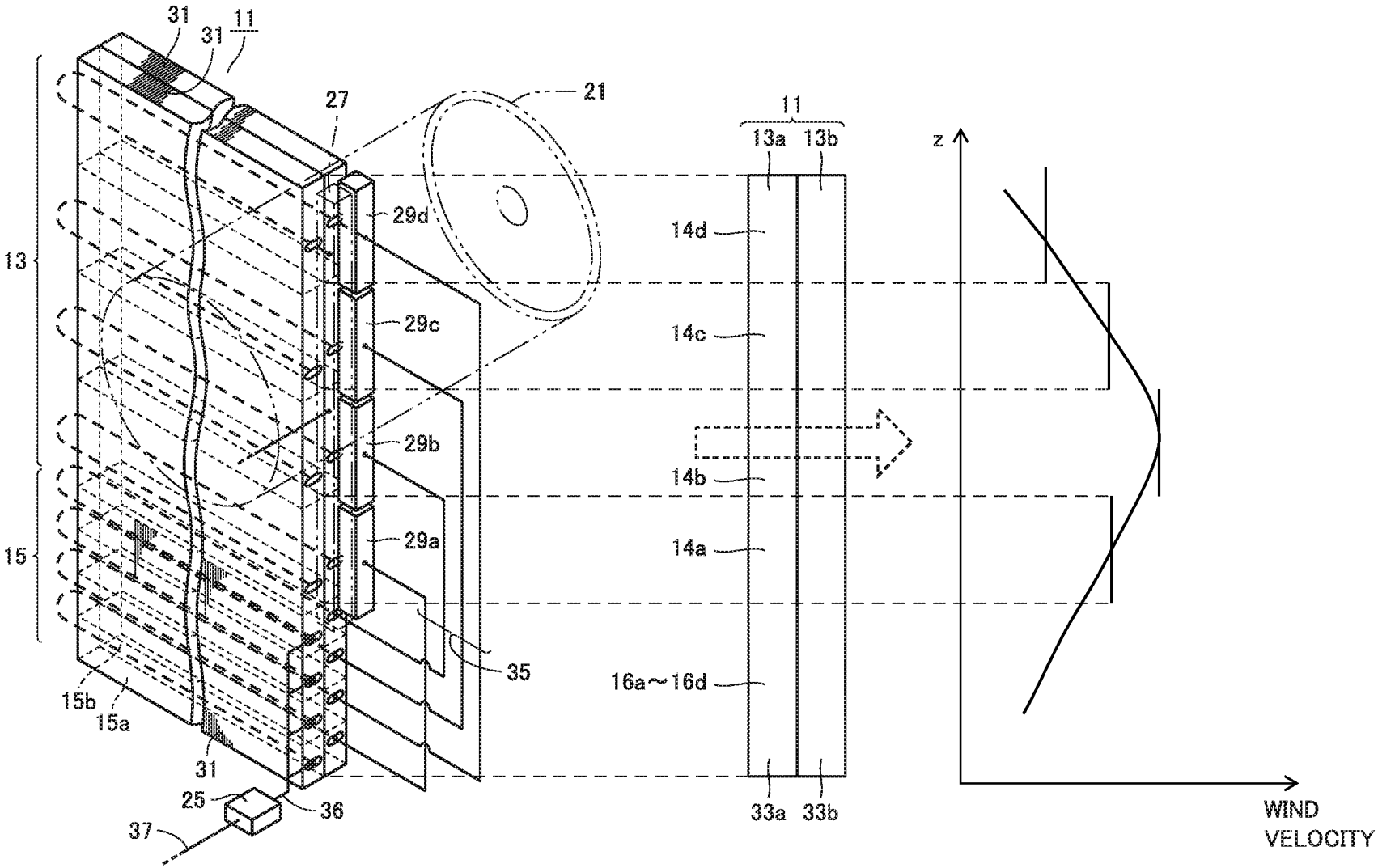
FIG. 9 shows the outdoor heat exchanger and wind velocity distribution of the outdoor air passing through the outdoor heat exchanger in the first embodiment.

Next, wind velocity distribution of the outdoor air (air) passing through outdoor heat exchanger 11 will be described. Now, outdoor unit 10 (see FIG. 1) housing outdoor heat exchanger 11 is assumed to be a lateral-blower outdoor unit, for example. In the lateral-blower outdoor unit, outdoor fan 21 is disposed so as to face outdoor heat exchanger 11 as shown in FIG. 9. Outdoor fan 21 rotates, and the outdoor air is thereby supplied from one side surface portion of the outdoor unit (not shown) into the outdoor unit. The supplied outdoor air passes through outdoor heat exchanger 11, and then, is delivered from the other side surface portion of the outdoor unit to the outside of the outdoor unit.

Depending on the positional relation with outdoor fan 21, wind velocity distribution of the outdoor air passing through outdoor heat exchanger 11 is generated. In a portion of outdoor heat exchanger 11 located closer to outdoor fan 21, the wind velocity of the outdoor air passing through the portion of outdoor heat exchanger 11 is higher. On the other hand, in a portion of outdoor heat exchanger 11 located farther from outdoor fan 21, the wind velocity of the outdoor air passing through the portion of outdoor heat exchanger 11 is lower.

Particularly, as shown in FIG. 9, the wind velocity of the outdoor air passing through a portion of outdoor heat exchanger 11 that faces outdoor fan 21 is higher than the wind velocity of the outdoor air passing through a portion of outdoor heat exchanger 11 that does not face outdoor fan 21. That is, the wind velocity of the outdoor air passing through a portion of outdoor heat exchanger 11 located inside a projection plane (region shown by a two-dot chain line) of outdoor fan 21 is higher than the wind velocity of the outdoor air passing through a portion of outdoor heat exchanger 11 located outside the projection plane.

Since such wind velocity distribution is generated, a percentage of contribution to heat exchange made by each portion of outdoor heat exchanger 11 to a total amount of heat exchange varies from portion to portion of outdoor heat exchanger 11. The percentage of contribution to heat exchange is relatively high in the portion of outdoor heat exchanger 11 located closer to outdoor fan 21, and is relatively low in the portion of outdoor heat exchanger 11 located farther from outdoor fan 21.

For example, in outdoor unit 10, the wind velocity (average value) of the outdoor air passing through refrigerant path group **14*b* is higher than the wind velocity (average value) of the outdoor air passing through refrigerant path group 14*d*. Therefore, a percentage of contribution to heat exchange made by refrigerant path group 14***b* is higher than a percentage of contribution to heat exchange made by refrigerant path group 14*d*. As described above, the amount of heat exchange in each refrigerant path (group) varies due to the wind velocity distribution.

As to each of refrigerant path groups 14*a* to 14*d* in main heat exchanger portion 13 of outdoor heat exchanger 11, description will be given of the refrigerant flowing through each of refrigerant path groups 14*a* to 14*d* and the heat exchange performance between the refrigerant and the outdoor air. First, as a comparative example, description will be given of the case in which the refrigerant in the two-phase state of liquid refrigerant and gas refrigerant flows uniformly into each of distribution devices 29*a* to 29*d*.

Figure 10:
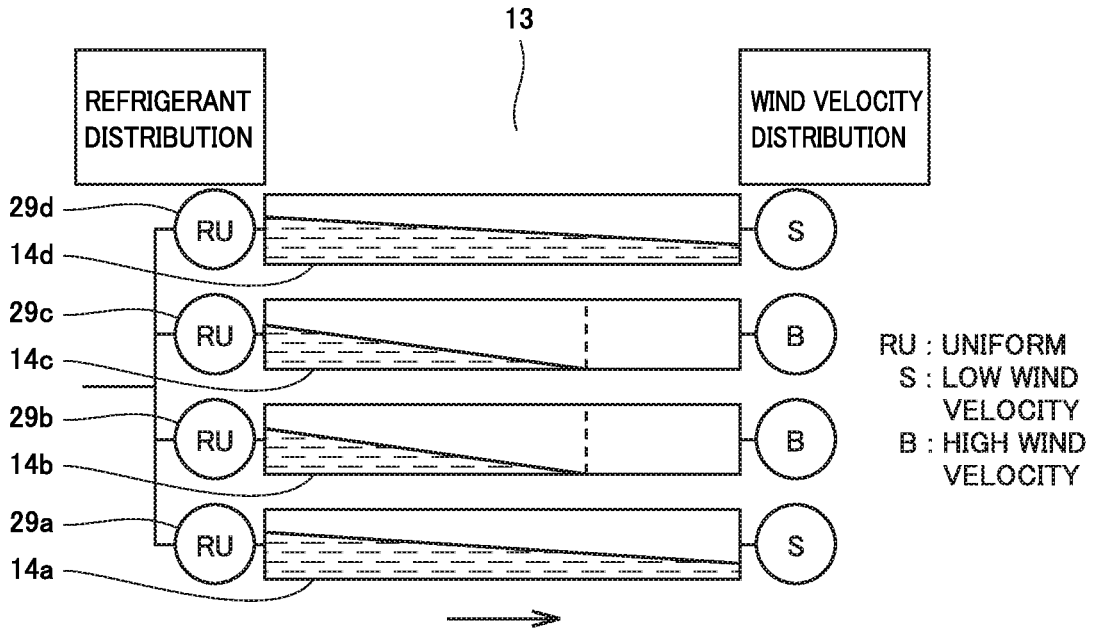
FIG. 10 schematically shows refrigerant distribution and wind velocity distribution in an outdoor heat exchanger according to a comparative example.

In this case, as shown in FIG. 10, while the refrigerant (liquid refrigerant) flowing uniformly into each of distribution devices 29*a* to 29*d* flows through each of refrigerant path groups 14*a* to 14*d*, heat exchange is performed between the refrigerant and the outdoor air and the refrigerant turns into gas refrigerant. Particularly, in main heat exchanger portion 13, the refrigerant is delivered from main heat exchanger portion 13 as the gas refrigerant (single phase), and thus, the liquid refrigerant flowing through refrigerant path groups 14*b* and 14*c* where the wind velocity is relatively high completes evaporation in the middle of refrigerant path groups 14*b* and 14*c* and turns into gas refrigerant.

On the other hand, the liquid refrigerant flowing through refrigerant path groups 14*a* and 14*d* where the wind velocity is relatively low does not complete evaporation even at exits of refrigerant path groups 14*a* and 14*d*, and thus, it is necessary to further heat the refrigerant to gas refrigerant. Therefore, in main heat exchanger portion 13, the refrigerant after the completion of heat exchange exists, while the refrigerant not subjected to sufficient heat exchange exists. Thus, the heat exchange performance of outdoor heat exchanger 11 on the whole deteriorates.

Figure 11:
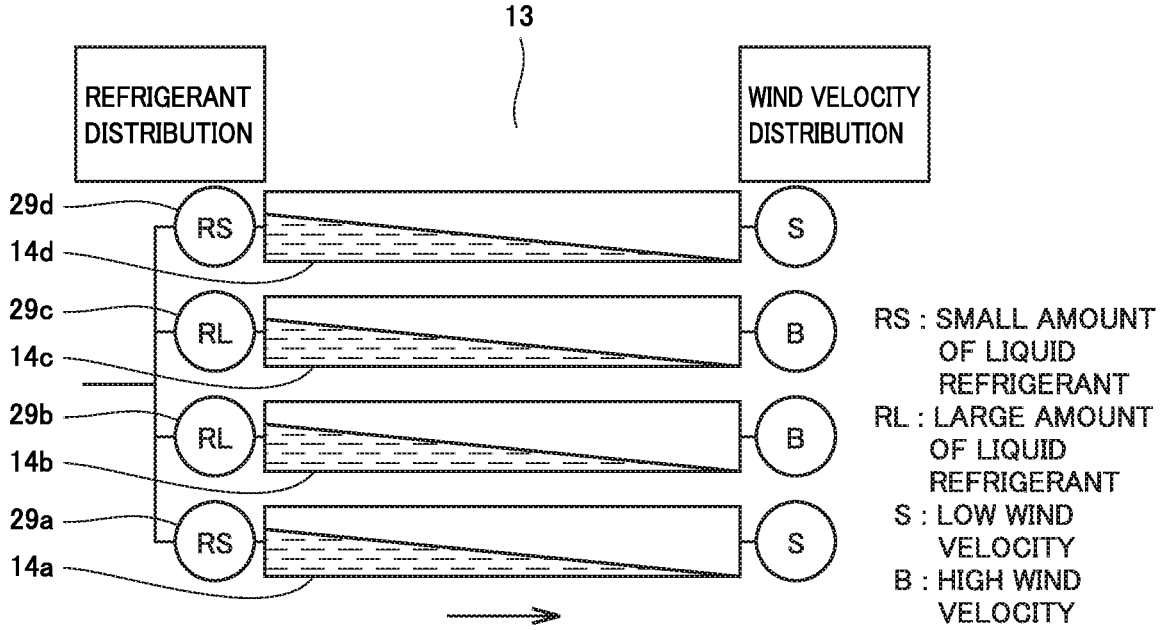
FIG. 11 schematically shows refrigerant distribution and wind velocity distribution in the outdoor heat exchanger in the first embodiment.

In contrast to the comparative example, in the first embodiment, refrigerant distribution is adjusted in accordance with wind velocity distribution as shown in FIG. 11. In this case, as described below, main heat exchanger portion 13 and auxiliary heat exchanger portion 15 are disposed such that the refrigerant including a larger amount of liquid refrigerant flows into refrigerant path groups 14*b* and 14*c* where the wind velocity is relatively high.

During heating operation, the refrigerant flowing into auxiliary heat exchanger portion 15 is distributed in distribution device 25, and then, flows through refrigerant paths 16*a* to 16*d*, distribution devices 29*a* to 29*d*, refrigerant path groups 14*a* to 14*d*, and header 27 sequentially. When fluctuations in friction pressure loss of the refrigerant occur in refrigerant paths 16*a* to 16*d* in auxiliary heat exchanger portion 15, a flow rate ratio of the refrigerant flowing through refrigerant paths 16*a* to 16*d* and refrigerant path groups 14*a* to 14*d* changes.

Figure 12:
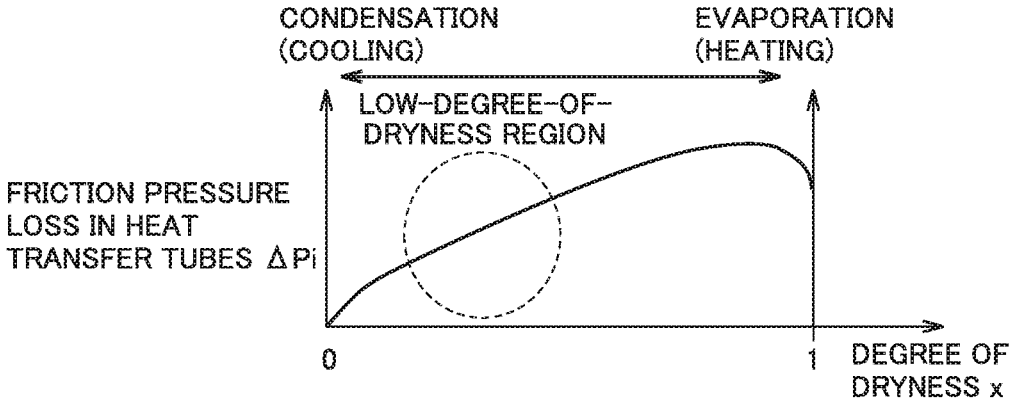
FIG. 12 is a graph showing the relation between a friction pressure loss in the heat transfer tubes and the degree of dryness in the first embodiment.

The relation between the degree of dryness of the refrigerant in the two-phase state of liquid refrigerant and gas refrigerant in the heat transfer tubes and the friction pressure loss of the refrigerant will be first described. The degree of dryness refers to a percentage (ratio) of a mass of the gas refrigerant to a mass of moist vapor (liquid refrigerant+gas refrigerant). FIG. 12 shows a graph of the relation. The horizontal axis represents the degree of dryness and the vertical axis represents the pressure loss in the heat transfer tubes.

As the degree of dryness becomes higher, an amount of gas refrigerant becomes larger. The refrigerant having the low degree of dryness flows into outdoor heat exchanger 11 functioning as an evaporator, and the refrigerant evaporates by the heat of the outdoor air, and thus, the degree of dryness becomes higher. As shown in FIG. 12, in a region where the degree of dryness is relatively low, the friction pressure loss of the refrigerant increases as the degree of dryness becomes higher. On the other hand, the friction pressure loss decreases monotonously as the degree of dryness becomes lower.

Since the refrigerant flowing into outdoor heat exchanger 11 functioning as an evaporator is the refrigerant in the two-phase state of liquid refrigerant and gas refrigerant, the temperature is a saturation temperature corresponding to the pressure. However, when the pressure decreases due to the friction pressure loss of the refrigerant and the like, the saturation temperature also decreases.

In outdoor heat exchanger 11 functioning as an evaporator, the refrigerant flows from auxiliary heat exchanger portion 15 to main heat exchanger portion 13. The number of refrigerant paths 16*a* to 16*d* in auxiliary heat exchanger portion 15 is smaller than the number of refrigerant path groups 14*a* to 14*d* in main heat exchanger portion 13. As a result, in auxiliary heat exchanger portion 15, the flow rate of the refrigerant flowing through refrigerant paths 16*a* to 16*d* is high and the friction pressure loss of the refrigerant is also high. Therefore, there is a temperature difference between the refrigerant (refrigerant A) flowing through refrigerant paths 16*a* to 16*d* in auxiliary heat exchanger portion 15 and the refrigerant (refrigerant B) flowing through refrigerant path groups 14*a* to 14*d* in main heat exchanger portion 13, and a temperature of refrigerant A is higher than a temperature of refrigerant B (refrigerant A>refrigerant B).

Auxiliary heat exchanger portion 15 is disposed below main heat exchanger portion 13 so as to be in contact with main heat exchanger portion 13. In auxiliary heat exchanger portion 15, refrigerant path 16*d* is located closest to main heat exchanger portion 13. Therefore, the heat transfers from refrigerant path 16*d* through which refrigerant A flows to main heat exchanger portion 13, and thus, the refrigerant in the two-phase state is cooled and condensed in refrigerant path 16*d* and the degree of dryness of the refrigerant becomes lower. Since the degree of dryness of the refrigerant becomes lower, the friction pressure loss of the refrigerant also decreases.

As a result, in auxiliary heat exchanger portion 15, a flow rate of the refrigerant (liquid refrigerant) flowing through refrigerant path 16*d* is higher than a flow rate of the refrigerant (liquid refrigerant) flowing through the other refrigerant paths. In outdoor heat exchanger 11 described above, refrigerant path 16*d* (first path) through which a larger amount of liquid refrigerant flows is connected to refrigerant path group 14*b* (second path) where a wind velocity of the outdoor air passing therethrough is relatively high. Thus, as shown in FIG. 11, the refrigerant including a larger amount of liquid refrigerant is subjected to efficient heat exchange and evaporates to gas refrigerant. As a result, the performance of outdoor heat exchanger 11 can be improved.

Figure 13:
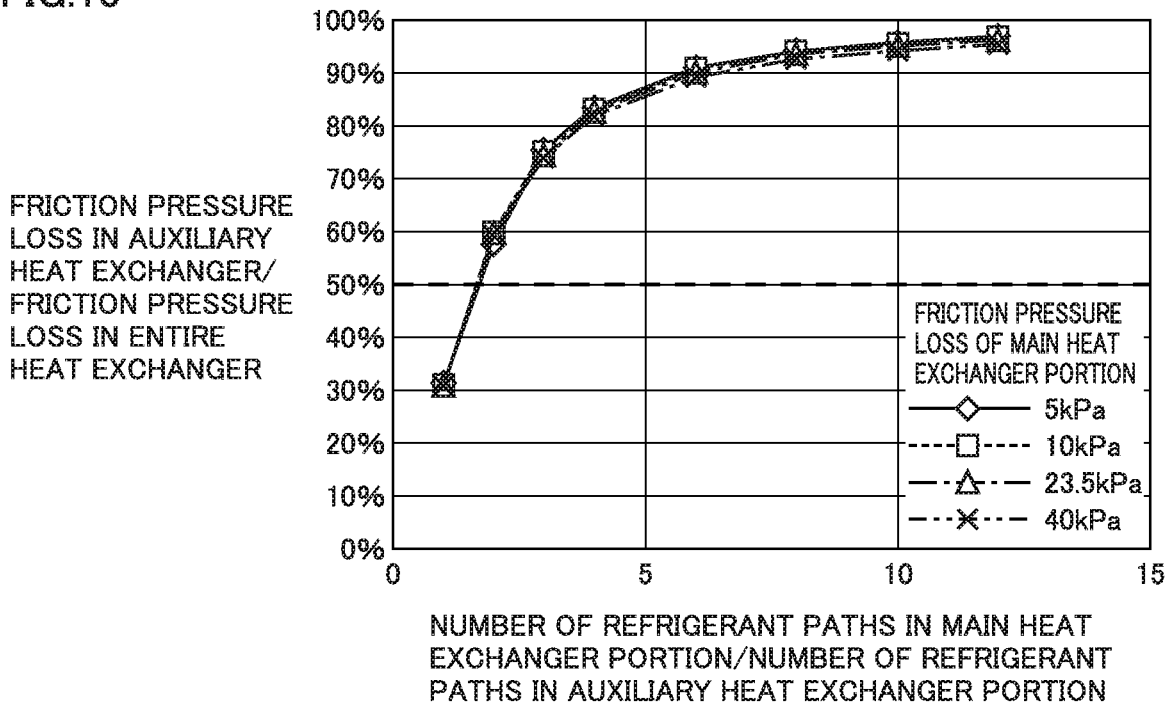
FIG. 13 is a graph showing the relation between a ratio of a friction pressure loss in an auxiliary heat exchanger portion to a friction pressure loss in an entire heat exchanger and a ratio of the number of refrigerant paths in a main heat exchanger portion to the number of refrigerant paths in an auxiliary heat exchanger portion in the first embodiment.

FIG. 13 shows the relation between a ratio of the friction pressure loss of the refrigerant in auxiliary heat exchanger portion 15 to the friction pressure loss of the refrigerant in main heat exchanger portion 13 and a ratio of the number of refrigerant paths in the main heat exchanger portion to the number of refrigerant paths in the auxiliary heat exchanger portion. The refrigerant is assumed to be R32. The number of heat transfer tubes per one refrigerant path is set to be the same. A pressure between main heat exchanger portion 13 and auxiliary heat exchanger portion 15 is set at 0.80 MPa (saturation temperature: −0.5° C.). The friction pressure loss in the main heat exchanger portion is calculated as a parameter.

Regardless of the friction pressure loss in main heat exchanger portion 13, when the number of refrigerant paths in main heat exchanger portion 13 is more than twice the number of refrigerant paths in auxiliary heat exchanger portion 15, the ratio of the friction pressure loss of the refrigerant in the auxiliary heat exchanger portion is more than half the total pressure loss in outdoor heat exchanger 11. Therefore, the friction pressure loss of the refrigerant becomes dominant in auxiliary heat exchanger portion 15, and the refrigerant can be easily distributed among refrigerant path groups 14*a* to 14*d* in main heat exchanger portion 13 due to a change in pressure loss in auxiliary heat exchanger portion 15.

Furthermore, during defrosting operation performed as appropriate in heating operation, the refrigerant flows from main heat exchanger portion 13 to auxiliary heat exchanger portion 15. The heat of the refrigerant flowing through main heat exchanger portion 13 is released to melt the frost adhering to main heat exchanger portion 13. Therefore, when the refrigerant flows through auxiliary heat exchanger portion 15, the refrigerant has already condensed sufficiently to liquid refrigerant.

In refrigerant path 16*d* of auxiliary heat exchanger portion 15 located closest to main heat exchanger portion 13, the refrigerant flowing through refrigerant path 16*d* is never subjected to phase change. In addition, fluctuations in friction pressure loss of the refrigerant hardly occur. Therefore, the heat exchange performance between the refrigerant and the outdoor air during operation as an evaporator (heating operation) can be improved, without affecting the distribution of the refrigerant during defrosting operation.

When refrigerant path 16*d* is not connected to refrigerant path group 14*a* of main heat exchanger portion 13 located closest to auxiliary heat exchanger portion 15, the following method can be adopted to prevent the frost from remaining. For example, a flow path cross-sectional area of the heat transfer tube of refrigerant path 16*d* is reduced. Alternatively, a diameter of the connection pipe connecting refrigerant path 16*d* and the distribution device is reduced.

As a result, a pressure resistance of refrigerant path 16*d* also increases, and a flow distribution ratio of the refrigerant flowing through refrigerant paths 16*a* to 16*d* in auxiliary heat exchanger portion 15 when outdoor heat exchanger 11 operates as an evaporator can be kept constant, and a flow distribution ratio in the refrigerant paths other than refrigerant path 16*d* can be increased during defrosting operation. As a result, a larger amount of refrigerant can flow through refrigerant path group 14*a* requiring an amount of heat and disposed in the lowest part of main heat exchanger portion 13, and thus, the frost can be reliably melted.

Second Embodiment

Figure 14:
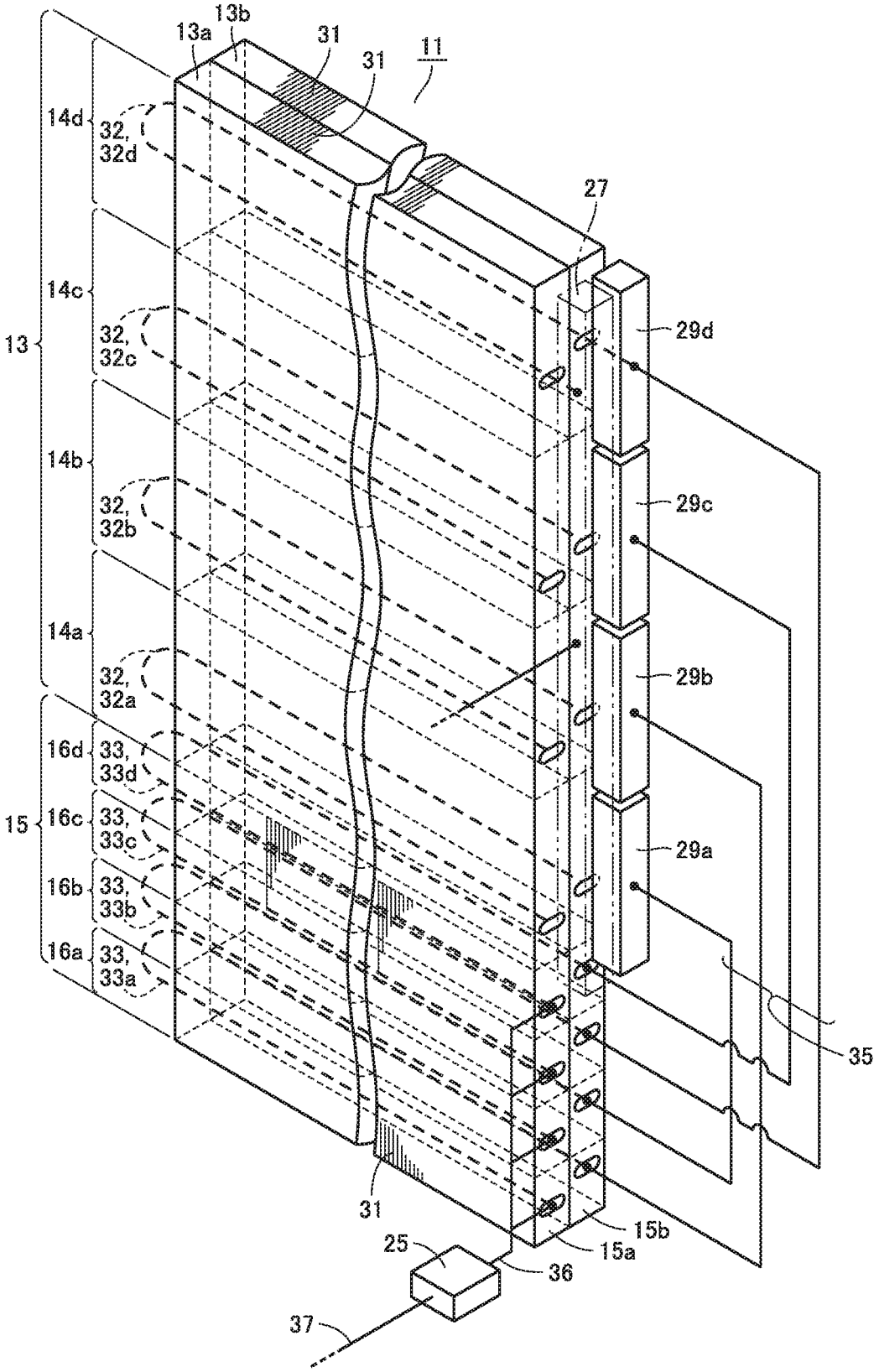
FIG. 14 is a perspective view showing an outdoor heat exchanger according to a second embodiment.

An outdoor heat exchanger of an outdoor unit according to a second embodiment will be described. As shown in FIG. 14, outdoor heat exchanger 11 includes main heat exchanger portion 13 (second heat exchanger portion) and auxiliary heat exchanger portion 15 (first heat exchanger portion). In main heat exchanger portion 13, refrigerant path groups 14*a*, 14*b*, 14*c*, and 14*d* (second refrigerant paths) are formed. In auxiliary heat exchanger portion 15, refrigerant paths 16*a*, 16*b*, 16*c*, and 16*d* (first refrigerant paths) are formed.

Outdoor heat exchanger 11 according to the second embodiment is different from outdoor heat exchanger 11 according to the first embodiment in terms of the manner of connection between refrigerant path groups 14*a*, 14*b*, 14*c*, and 14*d* and refrigerant paths 16*a*, 16*b*, 16*c*, and 16*d* Refrigerant path 16*a* (first path) disposed in the lowest part of auxiliary heat exchanger portion 15 is connected to refrigerant path group 14*b* (second path), of refrigerant path groups 14*a* to 14*d* in main heat exchanger portion 13, where a wind velocity of the outdoor air passing therethrough is relatively high.

Refrigerant path 16*b* is connected to refrigerant path group 14*a*. Refrigerant path 16*c* is connected to refrigerant path group 14*d*. Refrigerant path 16*d* is connected to refrigerant path group 14*c*. The remaining configuration is similar to the configuration of outdoor heat exchanger 11 shown in FIG. 2, and thus, the same members are denoted by the same reference characters and description thereof will not be repeated unless required.

Next, the operation of air conditioning apparatus 1 including the outdoor unit having above-described outdoor heat exchanger 11 will be described. The operation of air conditioning apparatus 1 is basically the same as the operation of air conditioning apparatus 1 according to the first embodiment.

First, during cooling operation, the refrigerant discharged from compressor 3 sequentially flows through four-way valve 23, outdoor heat exchanger 11, throttle device 9, and indoor heat exchanger 5, and returns to compressor 3 (see the dotted arrow in FIG. 5). In outdoor heat exchanger 11, heat exchange is performed between the high-temperature and high-pressure gas refrigerant and the outdoor air. The high-temperature and high-pressure gas refrigerant condenses to high-pressure liquid refrigerant (single phase).

In throttle device 9, the high-pressure liquid refrigerant turns into refrigerant in the two-phase state of low-pressure gas refrigerant and liquid refrigerant. In indoor heat exchanger 5, heat exchange is performed between the refrigerant in the two-phase state and the outdoor air. The liquid refrigerant evaporates to low-pressure gas refrigerant (single phase). As a result of this heat exchange, the interior of a room is cooled. Thereafter, this cycle is repeated.

Next, during heating operation, the refrigerant discharged from compressor 3 sequentially flows through four-way valve 23, indoor heat exchanger 5, throttle device 9, and outdoor heat exchanger 11, and returns to compressor 3 (see the solid arrow in FIG. 5). In indoor heat exchanger 5, heat exchange is performed between the high-temperature and high-pressure gas refrigerant and the outdoor air. The high-temperature and high-pressure gas refrigerant condenses to high-pressure liquid refrigerant (single phase). As a result of this heat exchange, the interior of a room is heated.

In throttle device 9, the high-pressure liquid refrigerant turns into refrigerant in the two-phase state of low-pressure gas refrigerant and liquid refrigerant. In outdoor heat exchanger 11, heat exchange is performed between the refrigerant in the two-phase state and the outdoor air. The liquid refrigerant evaporates to low-pressure gas refrigerant (single phase). Thereafter, this cycle is repeated.

Figure 15:
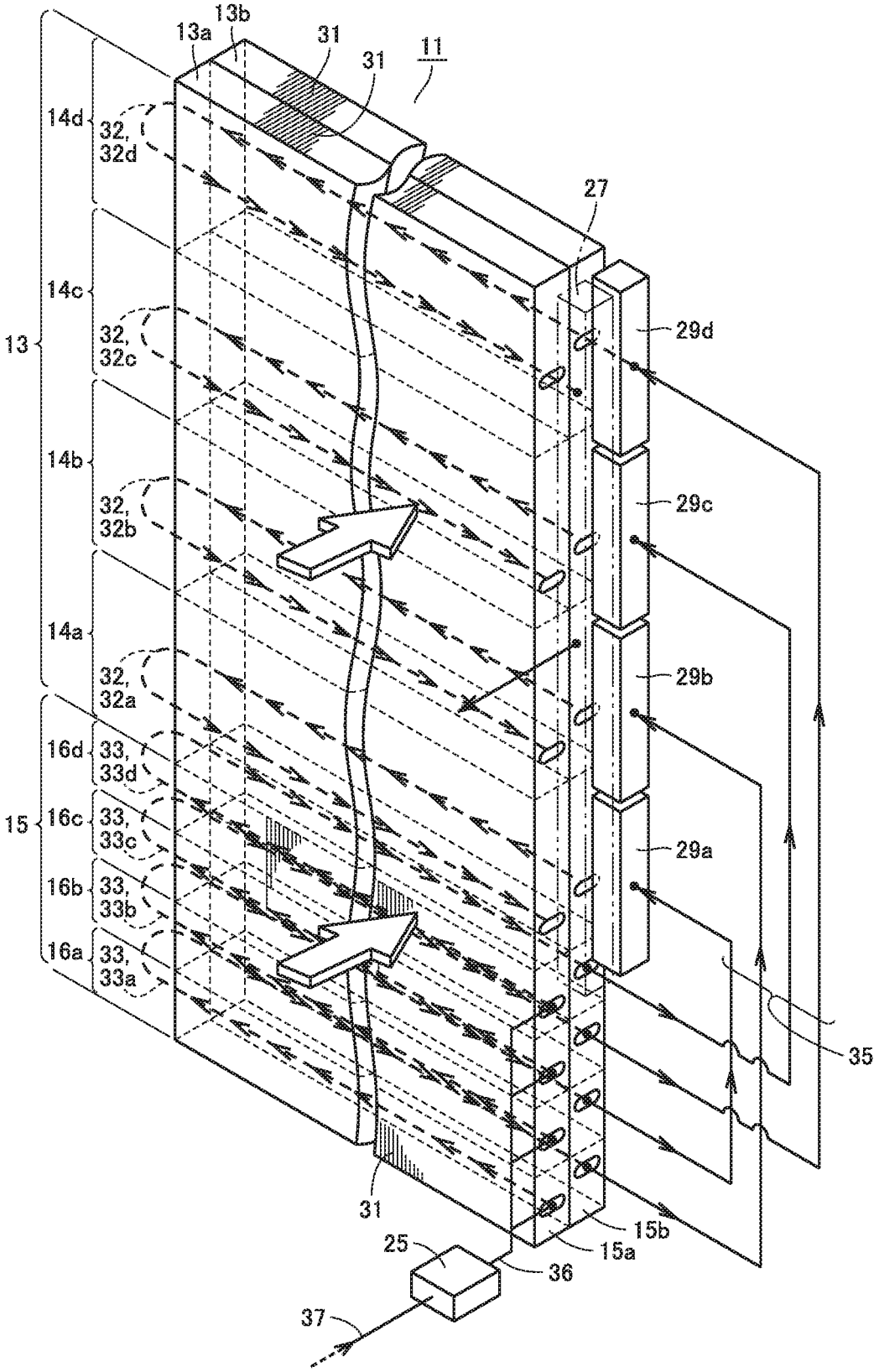
FIG. 15 shows a flow of refrigerant in the outdoor heat exchanger when the outdoor heat exchanger operates as an evaporator in the second embodiment.

Next, a flow of the refrigerant in outdoor heat exchanger 11 during heating operation will be described in detail. As shown in FIG. 15, the refrigerant in the two-phase state supplied from indoor heat exchanger 5 through throttle device 9 first flows into distribution device 25. The refrigerant flowing into distribution device 25 flows through refrigerant paths 16*a* to 16*d* in auxiliary heat exchanger portion 15 in a direction shown by an arrow. The refrigerant flowing through refrigerant path 16*a* flows into distribution device 29*b* via connection pipe 35. The refrigerant flowing through refrigerant path 16*b* flows into distribution device 29*a* via connection pipe 35. The refrigerant flowing through refrigerant path 16*c* flows into distribution device 29*d* via connection pipe 35. The refrigerant flowing through refrigerant path 16*d* flows into distribution device 29*c* via connection pipe 35.

Next, the refrigerant flowing into each of distribution devices 29*a* to 29*d* flows through refrigerant path groups 14*a* to 14*d* in main heat exchanger portion 13 in a direction shown by an arrow. The refrigerant flowing into distribution device 29*a* flows through refrigerant path group 14*a*. The refrigerant flowing into distribution device 29*b* flows through refrigerant path group 14*b*. The refrigerant flowing into distribution device 29*c* flows through refrigerant path group 14*c*. The refrigerant flowing into distribution device 29*d* flows through refrigerant path group 14*d*. The refrigerant flowing through each of refrigerant path groups 14*a* to 14*d* flows into header 27. The refrigerant flowing into header 27 is delivered to the outside of outdoor heat exchanger 11.

As described above, during heating operation, heat exchange is performed between the outdoor air supplied into outdoor unit 10 by outdoor fan 21 and the refrigerant supplied into outdoor heat exchanger 11. During this heat exchange, the moisture in the outdoor air (air) condenses and water droplets grow on a surface of outdoor heat exchanger 11. The grown water droplets flow downward through a drainage path of outdoor heat exchanger 11 formed by fins 31 and heat transfer tubes 32 and 33, and are discharged as the drain water.

At this time, the drain water is discharged from an upper part toward a lower part of outdoor heat exchanger 11 mainly due to the gravitational force, and thus, an amount of moisture is relatively larger in the lower part of outdoor heat exchanger 11. In the lower part of outdoor heat exchanger 11, measures are taken to prevent outdoor heat exchanger 11 from being damaged by corrosion of fins 31 or heat transfer tube 33. That is, the lower part of outdoor heat exchanger 11 is often in contact with only a part of a housing of the outdoor unit, or in contact with an insulator.

Therefore, the drain water is likely to accumulate in the lower part of outdoor heat exchanger 11. Particularly, the drain water is more likely to accumulate in refrigerant path 16*a* disposed in the lowest part of auxiliary heat exchanger portion 15 than in the other refrigerant paths 16*b* to 16*d*.

In addition, when a flat tube having a flat cross-sectional shape is used as the heat transfer tube, the surface tension on a lower surface of the heat transfer tube is greater than that of a general heat transfer tube having a circular cross-sectional shape. Therefore, the water droplets are likely to accumulate in the lowest part of auxiliary heat exchanger portion 15.

The drain water is the low-temperature water generated as a result of condensation of the moisture included in the outdoor air. The low-temperature drain water is likely to accumulate in refrigerant path 16*a*, and thus, the refrigerant in the two-phase state flowing through refrigerant path 16*a* is cooled and the gas refrigerant condenses. Since the gas refrigerant condenses, the degree of dryness of the refrigerant decreases and the refrigerant flowing through refrigerant path 16*a* is subjected to a decrease in friction pressure loss in heat transfer tube 33*a* (see FIG. 12). As a result, a flow rate of the refrigerant (liquid refrigerant) flowing through refrigerant path 16*a* increases and the flow rate of the refrigerant flowing through refrigerant path 16*a* becomes larger than a flow rate of the refrigerant flowing through the other refrigerant paths 16*b* to 16*d*.

Figure 16:
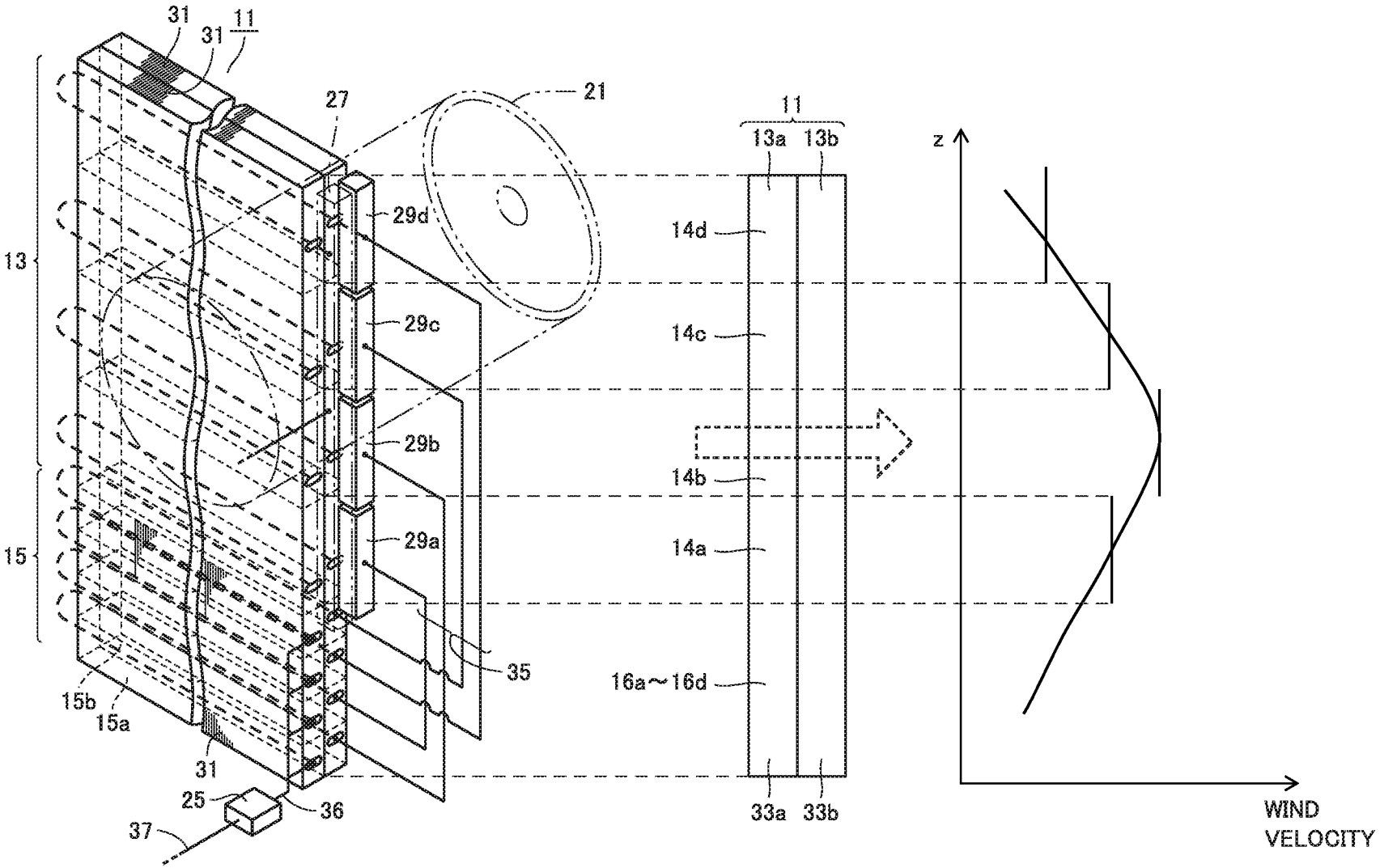
FIG. 16 shows the outdoor heat exchanger and wind velocity distribution of the outdoor air passing through the outdoor heat exchanger in the second embodiment.

As shown in FIG. 16, refrigerant path 16*a* in auxiliary heat exchanger portion 15 and refrigerant path group 14*b* in main heat exchanger portion 13 are connected by connection pipe 35. In refrigerant path group 14*b*, a wind velocity of the outdoor air passing therethrough is relatively high. Therefore, the refrigerant including a larger amount of liquid refrigerant is subjected to efficient heat exchange and evaporates to gas refrigerant. As a result, the performance of outdoor heat exchanger 11 can be improved.

A flow path shape in distribution device 25 or distribution devices 29*a* to 29*d* may be changed in order to adjust an amount of distribution of the refrigerant among refrigerant paths 16*a* to 16*d* and refrigerant path groups 14*a* to 14*d*. In addition, a dimension of connection pipe 36 connecting distribution device 25 and refrigerant paths 16*a* to 16*d* may be adjusted. Furthermore, a dimension of the connection pipe connecting distribution devices 29*a* to 29*d* and refrigerant paths 16*a* to 16*d* may be adjusted.

As described above, during defrosting operation performed as appropriate in heating operation, the heat of the refrigerant flowing through main heat exchanger portion 13 is released to melt the frost adhering to main heat exchanger portion 13. Therefore, when the refrigerant flows through auxiliary heat exchanger portion 15, the refrigerant has already condensed sufficiently to liquid refrigerant.

As a result, the refrigerant flowing through refrigerant paths 16*a* to 16*d* is never subjected to phase change due to the drain water generated during defrosting operation. In addition, fluctuations in friction pressure loss of the refrigerant hardly occur. Therefore, the heat exchange performance between the refrigerant and the outdoor air during operation as an evaporator (heating operation) can be improved, without affecting the distribution of the refrigerant during defrosting operation.

When refrigerant path 16*a* is not connected to refrigerant path group 14*a* of main heat exchanger portion 13 located closest to auxiliary heat exchanger portion 15, the following method can be adopted to prevent the frost from remaining. For example, a flow path cross-sectional area of the heat transfer tube of refrigerant path 16*a* is reduced. Alternatively, a diameter of the connection pipe connecting refrigerant path 16*a* and the distribution device is reduced.

As a result, a pressure resistance of refrigerant path 16*a* also increases, and a flow distribution ratio of the refrigerant flowing through the refrigerant paths in the auxiliary heat exchanger portion during operation as an evaporator can be kept constant, and a flow distribution ratio in the refrigerant paths other than refrigerant path 16*a* can be increased during defrosting operation. As a result, a larger amount of refrigerant can flow through refrigerant path group 14*a* requiring an amount of heat and disposed in the lowest part of main heat exchanger portion 13, and thus, the frost can be reliably melted.

Even when any refrigerant such as refrigerant R410A, refrigerant R407C, refrigerant R32, refrigerant R507A, and refrigerant HFO1234yf is used as the refrigerant used for air conditioning apparatus 1 described in each embodiment above, the heat exchanger performance during operation as an evaporator can be improved, without affecting the distribution during defrosting.

A refrigerator oil suitable in consideration of mutual solubility with the applied refrigerant is used as a refrigerator oil used for air conditioning apparatus 1. For example, in the case of fluorocarbon-based refrigerant such as refrigerant R410A, an alkyl benzene oil-based refrigerator oil, an ester oil-based refrigerator oil or an ether oil-based refrigerator oil is used. In addition to these refrigerator oils, a mineral oil-based refrigerator oil, a fluorine oil-based refrigerator oil or the like may be used.

The air conditioning apparatuses including the outdoor heat exchangers described in the embodiments can be variously combined as needed.

The embodiments disclosed herein are illustrative and non-restrictive. The present invention is defined by the terms of the claims, rather than the description above, and is intended to include any modifications within the scope and meaning equivalent to the terms of the claims.

INDUSTRIAL APPLICABILITY

The present invention is effectively utilized in an air conditioning apparatus including an outdoor heat exchanger having a main heat exchanger portion and an auxiliary heat exchanger portion.

REFERENCE SIGNS LIST

1 air conditioning apparatus; 3 compressor; 4 indoor unit; 5 indoor heat exchanger; 7 indoor fan; 9 throttle device; 10 outdoor unit; 11 outdoor heat exchanger; 13, 13*a*, 13*b* main heat exchanger portion; 14*a*, 14*b*, 14*c*, 14*d* refrigerant path group; 15, 15*a*, 15*b* auxiliary heat exchanger portion; 16*a*, 16*b*, 16*c*, 16*d* refrigerant path; 21 outdoor fan; 23 four-way valve; 25 distribution device; 27 header; 29*a*, 29*b*, 29*c*, 29*d* distribution device; 31 fin; 32, 32*a*, 32*b*, 32*c*, 32*d*, 33, 33*a*, 33*b*, 33*c*, 33*d* heat transfer tube; 35, 36, 37 connection pipe; 51 controller.

The invention claimed is:

1. An outdoor unit comprising an outdoor heat exchanger, the outdoor heat exchanger comprising:

a first heat exchanger portion; and a second heat exchanger portion in contact with the first heat exchanger portion, wherein the second heat exchanger portion has at least a relatively high air-velocity region and a relatively low air-velocity region, and air flows through the relatively high air-velocity region at a higher velocity than air flows through the relatively low air-velocity region;

the first heat exchanger portion has a plurality of first refrigerant paths, the second heat exchanger portion has a plurality of second refrigerant paths, a first path of the plurality of first refrigerant paths is connected to a second path of the plurality of second refrigerant paths, in such a manner of excluding a path of the plurality of second refrigerant paths closest to the first heat exchanger portion and a path of the plurality of second refrigerant paths farthest from the first heat exchanger portion, the first path is located closest to the second heat exchanger portion, the second path is disposed in the relatively high air-velocity region of the second heat exchanger portion, and in the outdoor heat exchanger, the refrigerant flows through the second heat exchanger portion and then the first heat exchanger portion during a cooling operation, and the refrigerant flows through the first heat exchanger portion and then the second heat exchanger portion during a heating operation.

2. The outdoor unit according to claim 1, wherein the number of the plurality of first refrigerant paths is smaller than the number of the plurality of second refrigerant paths.

3. The outdoor unit according to claim 1, further comprising a blower portion disposed to face the outdoor heat exchanger and configured to supply the fluid into the outdoor heat exchanger, wherein when the outdoor heat exchanger is viewed from the blower portion, the second path is located in a region where the blower portion and the second heat exchanger portion overlap with each other in a plan view.

4. The outdoor unit according to claim 1, wherein each of the plurality of first refrigerant paths and each of the plurality of second refrigerant paths comprise a heat transfer tube, and the heat transfer tube has a flat cross-sectional shape.

5. An outdoor unit comprising an outdoor heat exchanger, the outdoor heat exchanger comprising:

a first heat exchanger portion; and a second heat exchanger portion in contact with the first heat exchanger portion, wherein the second heat exchanger portion has at least a relatively high air-velocity region and a relatively low air-velocity region, and air flows through the relatively high air-velocity region at a higher velocity than air flows through the relatively low air-velocity region;

the first heat exchanger portion has a plurality of first refrigerant paths, the second heat exchanger portion has a plurality of second refrigerant paths, a first path of the plurality of first refrigerant paths is connected to a second path of the plurality of second refrigerant paths, the first path is located farthest from the second heat exchanger portion, the second path is disposed in the relatively high air-velocity region of the second heat exchanger portion, a third path of the plurality of first refrigerant paths is connected to a fourth path of the plurality of second refrigerant paths in such a manner of excluding a path of the plurality of second refrigerant paths closest to the first heat exchanger portion and a path of the plurality of second refrigerant paths farthest from the first heat exchanger portion, the third path is located closest to the second heat exchanger portion, the fourth path is disposed in the relatively high air-velocity region of the second heat exchanger portion, and in the outdoor heat exchanger, the refrigerant flows through the second heat exchanger portion and then the first heat exchanger portion during a cooling operation, and the refrigerant flows through the first heat exchanger portion and then the second heat exchanger portion during a heating operation.

6. The outdoor unit according to claim 5, wherein the first heat exchanger portion is disposed below the second heat exchanger portion, and the first path is disposed in a lowest part in the first heat exchanger portion.

7. The outdoor unit according to claim 5, wherein the number of the plurality of first refrigerant paths is smaller than the number of the plurality of second refrigerant paths.

8. The outdoor unit according to claim 5, further comprising a blower portion disposed to face the outdoor heat exchanger and configured to supply the fluid into the outdoor heat exchanger, wherein when the outdoor heat exchanger is viewed from the blower portion, the second path is located in a region where the blower portion and the second heat exchanger portion overlap with each other in a plan view.

9. The outdoor unit according to claim 5, wherein each of the plurality of first refrigerant paths and each of the plurality of second refrigerant paths comprise a heat transfer tube, and the heat transfer tube has a flat cross-sectional shape.

10. A refrigeration cycle apparatus comprising the outdoor unit as recited in claim 1, wherein when the outdoor heat exchanger operates as an evaporator, refrigerant flows from the first heat exchanger portion to the second heat exchanger portion.

11. A refrigeration cycle apparatus comprising the outdoor unit as recited in claim 5, wherein when the outdoor heat exchanger operates as an evaporator, refrigerant flows from the first heat exchanger portion to the second heat exchanger portion.

* * * * *